United States Patent [19]

Erickson

[11] 4,247,142

[45] Jan. 27, 1981

[54] BOTTLE CARRIER

[76] Inventor: Gerald Erickson, P.O. Box 747, Palm Beach, Fla. 33480

[21] Appl. No.: 94,780

[22] Filed: Nov. 16, 1979

[51] Int. Cl.[3] ..... B65D 71/00

[52] U.S. Cl. ..... 294/87.2; 206/199

[58] Field of Search ..... 294/87.2, 87.28, 99 R; 206/139, 145, 151, 159, 161, 162, 168, 199, 150; 224/45 A, 45 AA; D9/178

[56] References Cited

U.S. PATENT DOCUMENTS

| | | | |
|---|---|---|---|
| 2,936,070 | 5/1960 | Poupitch | 294/87.2 X |
| 3,633,962 | 1/1972 | Erickson | 294/87.2 |
| 3,968,914 | 7/1976 | Goncalves | 294/87.2 X |
| 4,093,295 | 6/1978 | Erickson | 294/87.2 |

FOREIGN PATENT DOCUMENTS

| | | | |
|---|---|---|---|
| 2068858 | 9/1971 | France | 294/87.28 |

*Primary Examiner*—Johnny D. Cherry
*Attorney, Agent, or Firm*—Brumbaugh, Graves, Donohue & Raymond

[57] ABSTRACT

An integrally formed bottle carrier in which a plurality of openings is formed in a one-piece frame and each opening includes at least two pairs of diagonally extending bottle engaging and supporting ribs oppositely disposed within the opening, one pair being longer in length and adapted to be spread apart to facilitate the removal of a neck of a bottle and the other pair being shorter in length and serving as a fulcrum against which the neck of a bottle is pivoted to force the upper end between the two longer ribs.

6 Claims, 4 Drawing Figures

BOTTLE CARRIER

This invention relates to an integrally formed bottle carrier for supporting a plurality of bottles in a close cluster.

The integrally formed bottle carrier of the present invention embodies a one-piece carrier having a plurality of spaced-apart openings therein and a plurality of bottle engaging and centering fingers or ribs individually connected at their outer ends with the carrier. Their inner ends extend into the openings and define the shape of the outer perimeter of the bottle which they are adapted to engage and support. The necks of the bottles to be carried can be readily inserted into and removed from the bottle carrier.

Bottle carriers capable of supporting a plurality of bottles by their necks have been heretofore proposed. For example, bottle carriers of this type are disclosed in U.S. Pat. Nos. 3,633,962 issued Jan. 11, 1972 and 4,093,295 issued Jan. 6, 1978 and in United States pending application Ser. Nos. 29,715 and 29,716 filed Apr. 13, 1979. The bottle carriers disclosed therein embody a frame having a plurality of spaced-apart collars for receiving and supporting therein the necks of the bottles to be carried. In the bottle carrier of the present invention, these collars are eliminated in whole or in part so that the ribs or fingers position and support the bottles and hold them in a nested configuration.

The bottle carrier of the present invention is lighter in weight and is more economical in that it utilizes less material than the bottle carriers embodying individual collars which support the bottles. Moreover, the bottles can be readily inserted and removed inasmuch as the individual bottle engaging and supporting fingers or ribs are in whole or in part unconnected and unsupported at their inner ends to facilitate bending and deflection in all directions while at the same time possessing sufficient rigidity to support the bottles.

Figure 1:
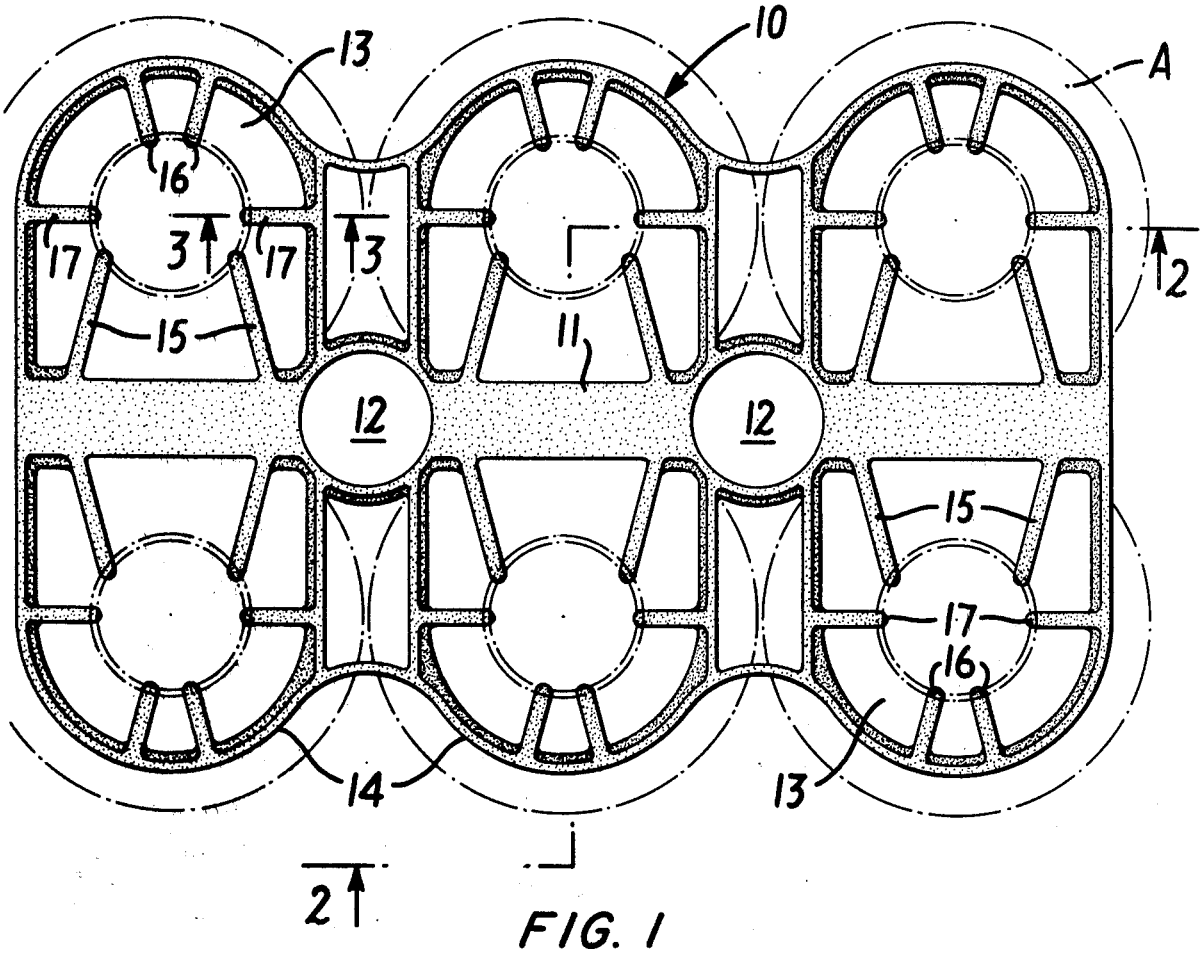
Figure 4:
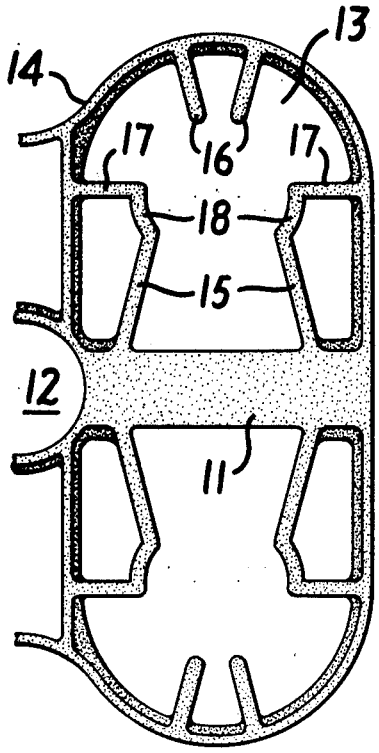
Figure 2:
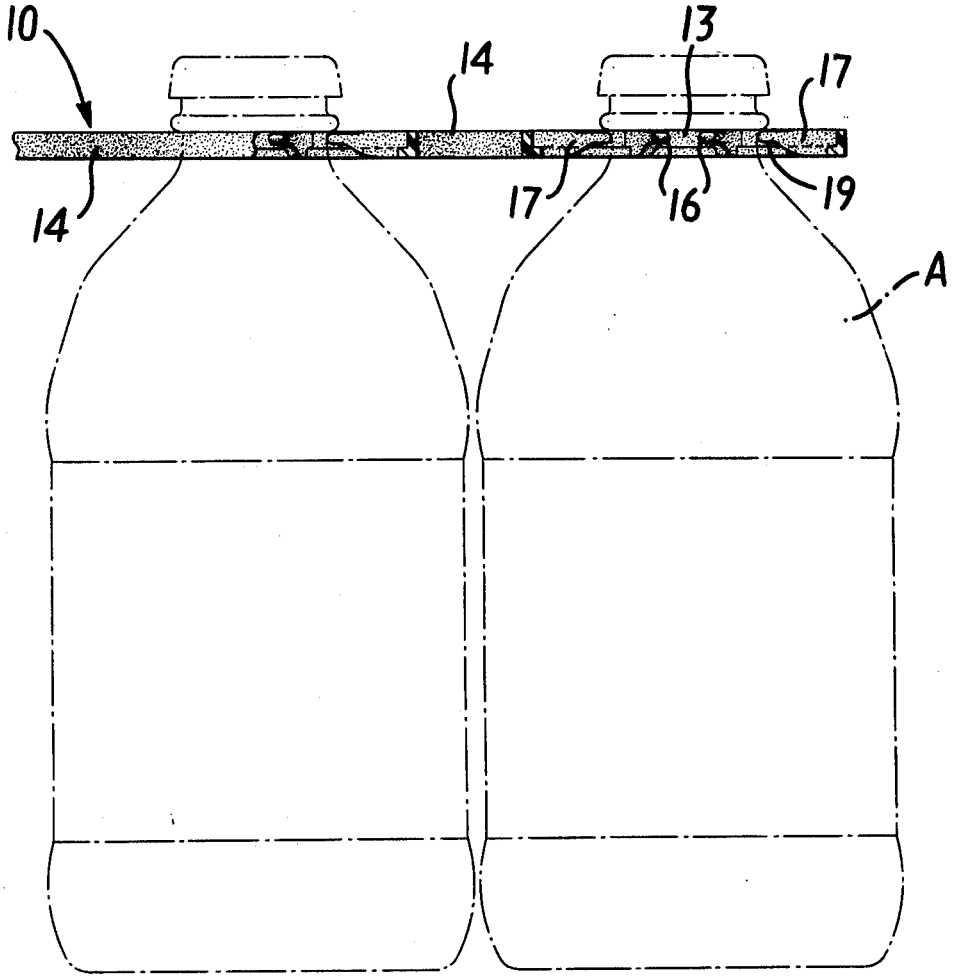
Figure 3:
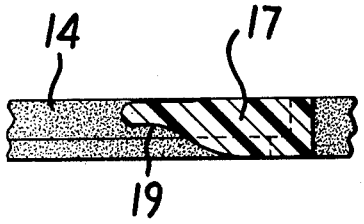

These and other advantages and features of the present invention will be apparent from the detailed description which follows and from the accompanying drawings, in which:

FIG. 1 is a plan view of a bottle carrier of the present invention;

FIGS. 2 and 3 are views taken along the lines 2—2 and 3—3, respectively, of FIG. 1 looking in the direction of the arrows; and FIG. 4 is a fragmentary plan view of a portion of an alternative embodiment of the bottle carrier of the present invention.

A bottle carrier embodying the present invention, as shown in FIGS. 1 through 3, includes an integrally formed bottle carrying frame 10 for receiving and supporting therein the necks of the bottles A to be packaged. The frame 10 is molded in one piece from any suitable plastic material, and it has a longitudinally extending bar 11 which, in the six-bottle carrier shown in FIG. 1, extends substantially the length of the longer dimension of the frame. The bar 11 has a pair of finger gripping openings 12 to facilitate handling. If desired, a handle can be provided or the bar 11 can serve as a handle.

The carrier has a plurality of spaced-apart openings 13 therein, each receiving and supporting the neck of a bottle. Each opening 13 is encompassed by an individual frame 14. In the embodiment shown in the drawings, the longitudinally extending bar 11 forms the inner legs of all of the individual frames 14.

Each of the individual frames 14 accommodates a plurality of separate ribs or fingers integrally connected at their outer ends to the respective frame. The inner ends of those ribs or fingers engage and support the necks of the bottles. More specifically, each of the individual frames 14 includes at least a pair of relatively long ribs or fingers 15 which extend diagonally to each other, with their inner ends more closely spaced apart than their outer ends. The ribs or fingers 15 extend inwardly from the longitudinally extending bar 11 toward the center of the respective opening 13. Moreover, each of the individual frames 14 includes a pair of ribs or fingers 16 shorter in length than the ribs or fingers 15 and which extend diagonally to each other, with their inner ends more closely spaced apart than their outer ends. The ribs or fingers 16 extend inwardly from the portion of the frame opposite the longitudinally extending bar 11.

The frames 14 also include a pair of oppositely disposed inwardly projecting ribs or fingers 17 which extend generally parallel to the longitudinally extending bar 11 so that each rib or finger 17 is disposed intermediate one of the longer ribs 15 and one of the shorter ribs 16. The inner ends of the ribs or fingers 15, 16 and 17 define the shape of the outer perimeter of the bottle which they are adapted to engage and support.

The outer ends of the ribs or fingers 15, 16 and 17 are preferably of greater effective cross-section than the inner ends so as to impart greater strength and rigidity to the outer ends and greater flexibility and resiliency to the inner ends. The inner ends are preferably tapered upwardly, as shown by the reference numeral 19 in FIG. 3, so as to be more easily deflectable in all directions to facilitate the insertion and removal of the neck of the bottle. As a general rule, when the carrier is applied to the bottles, the carrier and the bottles will be moved relative to each other, thereby loading the bottles simultaneously into the bottle carrier. The tapered or flanged inner ends of the ribs or fingers will readily deflect upwardly independently of one another to facilitate such automatic loading of the bottles.

The bottles ordinarily will be removed one at a time from the bottle carrier by gripping the bottle and moving the lower end thereof outwardly of the longitudinally extending bar 11, thereby forcing the neck between the longer ribs or fingers 15, using the shorter ribs or fingers as a fulcrum. The longer ribs or finbers 15 separate and permit the upper end of the bottle to pass between the outer ends thereof. The ribs or fingers can be made as heavy or as thin as the weight of the bottles dictate so as to permit simultaneous loading and to facilitate removal.

An alternative embodiment of the bottle carrier is shown in FIG. 4 in which each of the lower ribs 15 is connected to the adjacent rib 17 by a curved guide 18. The guide 18 helps guide the neck of the bottle between the longer ribs or fingers 15.

The bottle carrier of the present invention can be made to accommodate two or more bottles and, if desirable, it can be equipped with the bottle-retaining bar or loop, disclosed in the pending application Ser. No. 29,715, for engaging the outer portions of a plurality of bottles and maintaining them in close clustered relationship.

The invention has been shown in the preferred forms and by way of example only, and many modifications and variations may be made therein without departing from the spirit of the invention. The invention, therefore, is not to be limited to any specified form or embodiment, except insofar as such limitations are expressly set forth in the claims.

I claim:

1. An integrally formed bottle carrier comprising a one-piece frame having a plurality of spaced-apart openings therein and a plurality of bottle engaging and supporting ribs integrally connected at their outer ends with the frame, their inner ends defining the shape of the outer perimeter of the bottle which they are adapted to engage and support, at least two of the ribs being longer than the others and extending diagonally to each other with their inner ends more closely spaced apart than their outer ends, said longer ribs being adapted to be spread apart to facilitate the removal of the neck of a bottle, at least two of the ribs being shorter than the longer ribs and extending diagonally to each other from the opposite end of the opening with their inner ends more closely spaced apart than their outer ends, the inner ends of said shorter ribs being unconnected and unsupported except for their connection at their outer ends to the frame so that they are deflectable separately in all directions and relative to each other on the insertion of the neck of a bottle, the shorter ribs serving as a fulcrum against which the neck of a bottle is pivoted to force the upper end between the two longer ribs.

2. An integrally formed bottle carrier as set forth in claim 1 in which both the longer and shorter ribs are unsupported and unconnected except for their support from and connection to the frame at their outer ends.

3. An integrally formed bottle carrier as set forth in claim 1 including a pair of oppositely disposed inwardly projecting ribs intermediate the pairs of longer and shorter ribs.

4. An integrally formed bottle carrier as set forth in claim 3 including a guide connecting each of the longer ribs to an adjacent one of said oppositely disposed ribs to guide the neck of a bottle between the longer ribs on removal.

5. An integrally formed bottle carrier as set forth in claim 1 in which the inner ends of at least some of the bottle engaging and supporting ribs are tapered and the outer ends are of greater effective cross-section, so that the outer ends are more rigid and the inner ends more resilient and deflectable.

6. An integrally formed bottle carrier as set forth in claim 1 in which the frame includes a reinforcing bar intermediate a pair of spaced-apart openings and in which the longer ribs of adjacent openings extend in opposite directions from the bar with their outer ends connected to the bar, the pairs of shorter ribs being integrally connected to portions of the frame more remotely located with respect to the reinforcing bar.

* * * * *